US011092316B2

(12) United States Patent
Anderson

(10) Patent No.: US 11,092,316 B2
(45) Date of Patent: Aug. 17, 2021

(54) FRAME WITH LIGHTED DISPLAY

(71) Applicant: Rick Anderson, Minneapolis, MN (US)

(72) Inventor: Rick Anderson, Minneapolis, MN (US)

( * ) Notice: Subject to any disclaimer, the term of this patent is extended or adjusted under 35 U.S.C. 154(b) by 0 days.

(21) Appl. No.: 16/268,862

(22) Filed: Feb. 6, 2019

(65) Prior Publication Data

US 2019/0293266 A1 Sep. 26, 2019

Related U.S. Application Data

(60) Provisional application No. 62/595,149, filed on Dec. 6, 2017.

(51) Int. Cl.

| | |
|---|---|
| ***G09F 13/00*** | (2006.01) |
| ***F21V 15/01*** | (2006.01) |
| ***F21V 21/02*** | (2006.01) |
| ***F21V 3/02*** | (2006.01) |
| ***F21S 6/00*** | (2006.01) |
| ***F21S 8/08*** | (2006.01) |
| *F21Y 115/10* | (2016.01) |
| *G09F 13/04* | (2006.01) |

(52) U.S. Cl.

CPC ..... *F21V 15/01* (2013.01); *F21S 6/005* (2013.01); *F21S 8/081* (2013.01); *F21V 3/02* (2013.01); *F21V 21/02* (2013.01); *F21Y 2115/10* (2016.08); *G09F 13/00* (2013.01); *G09F 13/0413* (2013.01); *G09F 2013/0431* (2013.01); *G09F 2013/0436* (2013.01)

(58) Field of Classification Search

CPC ..... F21S 6/005; F21S 8/081; F21V 15/01; F21V 21/02; F21V 3/02; F21W 2131/103; F21Y 2103/33; F21Y 2115/10; G09F 13/0413; G09F 2013/0436; G09F 2013/0468; G09F 2013/0431

See application file for complete search history.

(56) References Cited

U.S. PATENT DOCUMENTS

| | | | | |
|---|---|---|---|---|
| 1,843,630 | A * | 2/1932 | Richmond | G09F 13/04 40/572 |
| 3,426,463 | A * | 2/1969 | Weisenbach | G09F 23/00 40/587 |
| 4,214,683 | A * | 7/1980 | Wills | B60B 7/00 224/42.2 |
| 5,316,376 | A * | 5/1994 | Defreitas | G09F 21/045 301/37.25 |
| 5,934,796 | A * | 8/1999 | Quereau | F21S 8/00 362/101 |
| 5,996,863 | A * | 12/1999 | Burke | G09F 21/045 150/166 |
| 7,296,918 | B1 * | 11/2007 | Davydyuk | B60B 3/002 362/473 |
| 7,681,347 | B1 * | 3/2010 | Welker | G02B 6/0016 40/546 |
| 8,893,414 | B1 * | 11/2014 | Zachorne | G09F 13/14 40/555 |
| 2004/0045199 | A1 * | 3/2004 | Ki | G09F 13/04 40/546 |
| 2007/0119081 | A1 * | 5/2007 | Kazunao | G09F 21/04 40/587 |

(Continued)

*Primary Examiner* — Zheng Song

(74) *Attorney, Agent, or Firm* — Taft Stettinius & Hollister LLP; Daniel A. Rosenberg

(57) ABSTRACT

The present invention relates to a lighted display. In particular, to a circular frame having a lighted display attached to the center.

7 Claims, 10 Drawing Sheets

(56) References Cited

U.S. PATENT DOCUMENTS

2010/0321919 A1* 12/2010 Yang ..... F21S 8/00
362/84
2012/0106198 A1* 5/2012 Lin ..... G02B 6/0083
362/609
2018/0053447 A1* 2/2018 Jensen ..... G09F 21/043

* cited by examiner

FRAME WITH LIGHTED DISPLAY

RELATED APPLICATIONS

The present application claims priority to and incorporates by reference hereto United Provisional Patent Application No. 62/595,149 filed on Dec. 6, 2017.

BACKGROUND OF THE INVENTION

Field of the Invention

The present invention relates to a lighted display. In particular, to a circular frame having a lighted display attached to the center.

Background

SEGs are a printed fabric material particularly suited for use with extrusion-based displays. SEG graphics feature a silicone edge gasket attached to one or more edges of the printed graphic, enabling the edge to pressure fit into a channel on a frame to present a seamless display surface.

SEGs are ideal for use with a multitude of different display products, and for use with backlit LED illuminated and non-illuminated dye-sublimated fabric graphics. On advantage of SEGs is that they can be held firmly in place and the fabric is stretched under tension to provide a seamless and wrinkleless appearance for dramatic effect. Thus, it is important to use a material with some stretch to allow for easy installation and to keep the graphic taught in the frame system. SEGs produced with fabrics without suitable stretch may fit poorly on the frame and sag after multiple uses.

Application and removal of SEGs is easy. Initially, the SEG edge bead is pressed into a first location of the frame to ensure that graphic will be properly aligned once fitted. Then the edge bead is pressed into the remainder of the channels usually with the fingers (a tool can be used) until all the edge beading is pushed into the channels. Removal is as simple as pulling the tab located on the graphic to remove a portion of the graphic from the channel, and then gently pulling the rest of the beaded edge out of the frame channel.

A drawback of prior art SEG systems is that they are not suitable for use in unconventional settings, as they are typically used with standard shaped frames and for static display purposes.

Thus, a need exists for a graphic display adapted for use with SEGs that can be used in a wider array of settings, and are suitable thereto.

DETAILED DESCRIPTION OF THE INVENTION

The present invention, comprises a generally circular shaped lighted display 10 suitable for use with an SEG graphic, and includes internal lighting and other components for creating a multi-media visual presentation on the SEG. The invention includes multiple embodiments.

Figure 1:
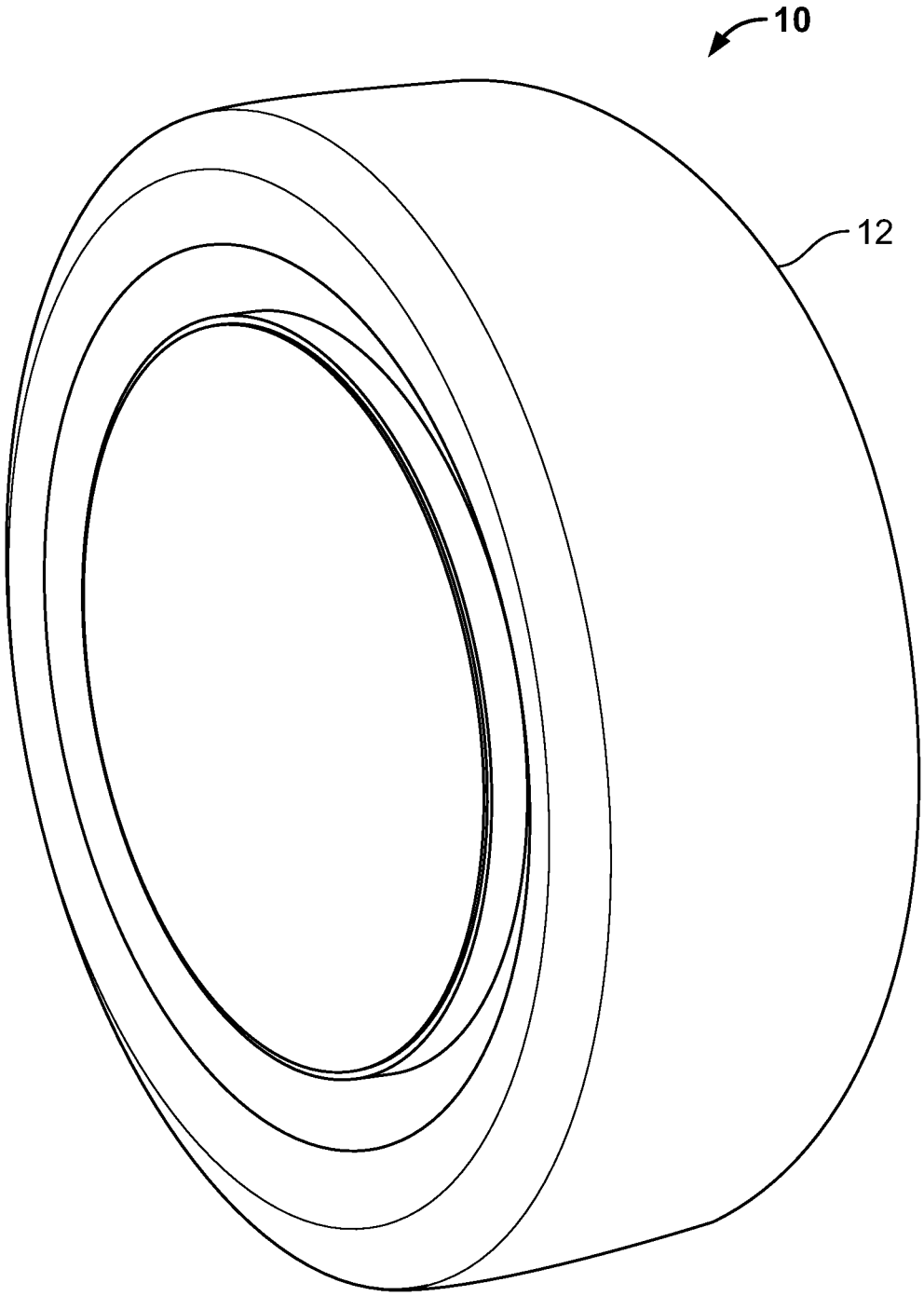
FIG. 1 shows a perspective view of a lighted display of the present invention mounted in the center of a tire.
Figure 2C:
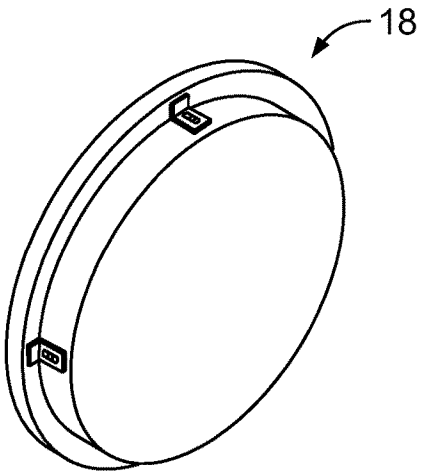
FIG. 2C shows a back perspective view of the display.
Figure 2B:
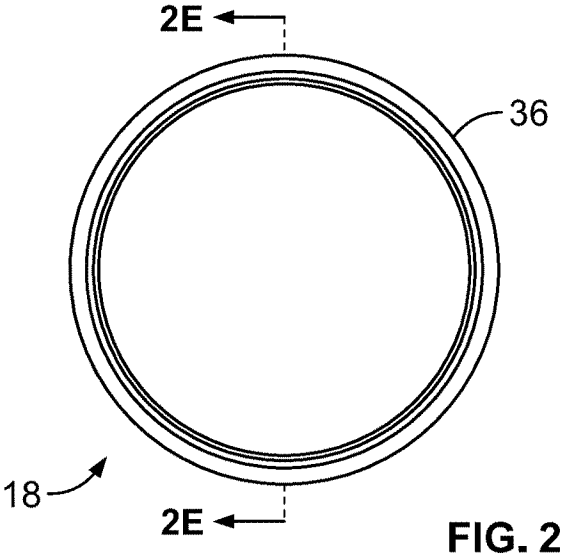
FIG. 2B shows a front view of the display.
Figure 2A:
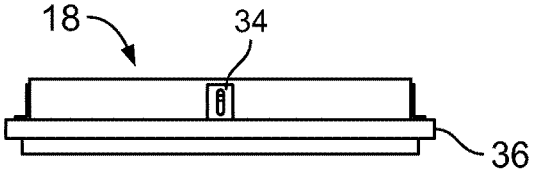
FIG. 2A shows a side view of the display.
Figure 2F:
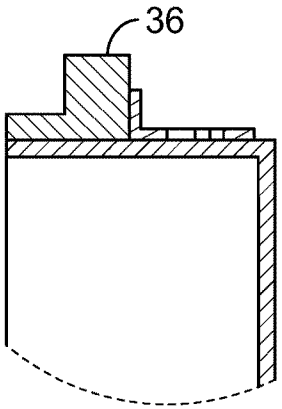
FIG. 2F shows an enlarged view of the top portion of the side of the display shown in the circle of FIG. 2E.
Figure 2E:
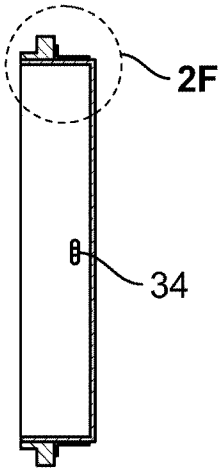
FIG. 2E shows a side view of the display taken along the line AA shown in FIG. 2B.
Figure 2D:
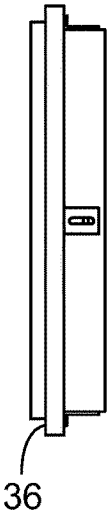
FIG. 2D shows another side view of the display.

In one embodiment, a tire 12 is shown having an internally mounted lighted display 10 therein. In particular, FIG. 1 shows a tire 12 having a lighted display 10 mounted in the center opening of the tire 12. The display 10 is illuminated by a strip of lights 16 located on the inside of the display 10, and preferably by a strip of LED lights.

Figure 3:
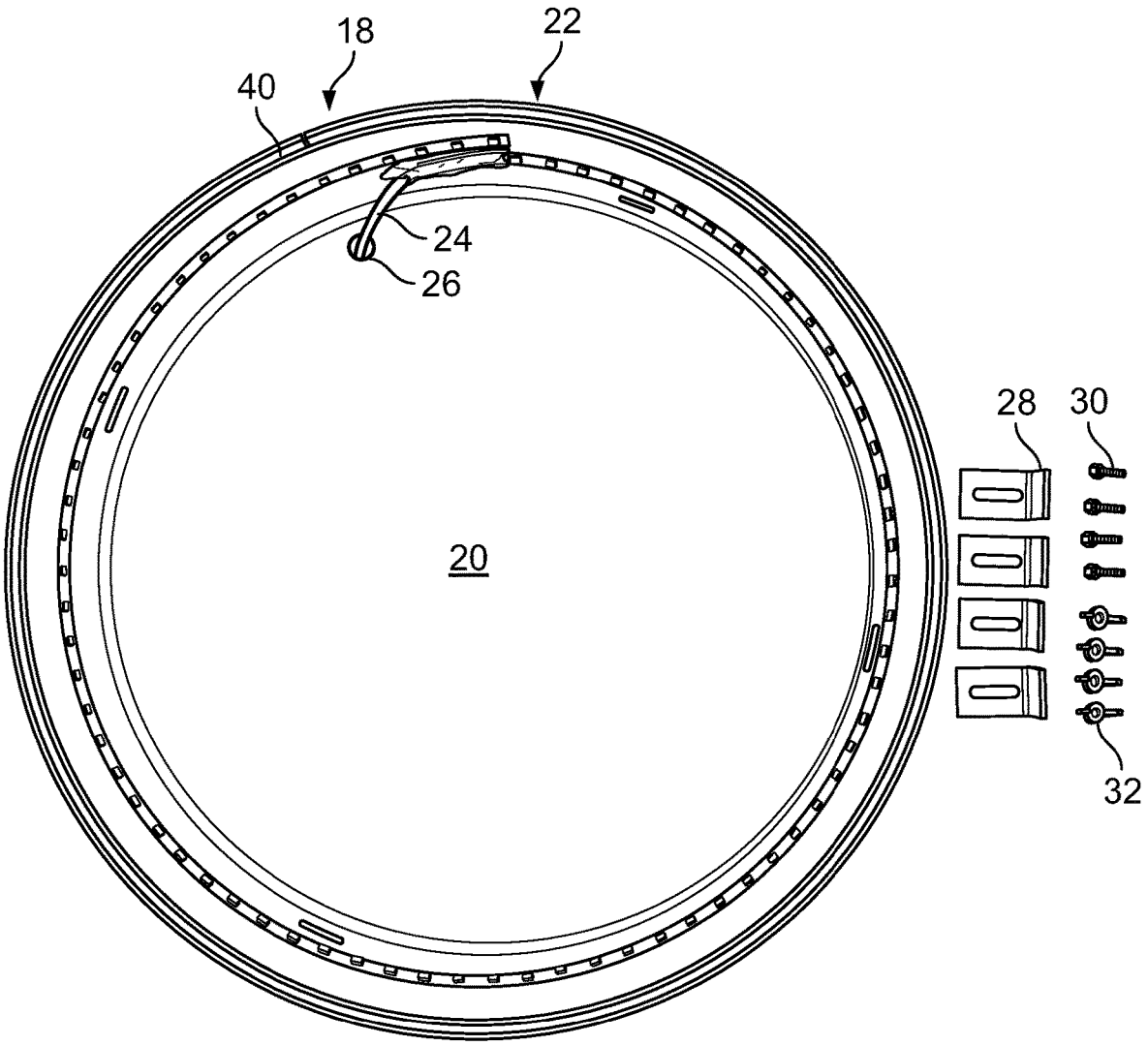
FIG. 3 is a front view of the display, including brackets and screws.

The display 10, as seen in FIGS. 2A-F, is of a modular design. FIGS. 2A-F show multiple views of the display 10, which are described in detail below. As seen in the FIG. 3, the display comprises a center bowl 18, which has a closed back 20, an open top, and a side 22 around the circumference of the bowl 18. FIG. 3 shows the inside of the bowl 18. The inner rim of the side 22 of the bowl 18 is lined with LEDs lights 14, and a power cord 24 runs from the LEDs 22 out a hole 26 in the back 20 of the bowl 18 to a power source (see FIG. 4).

Figure 5:
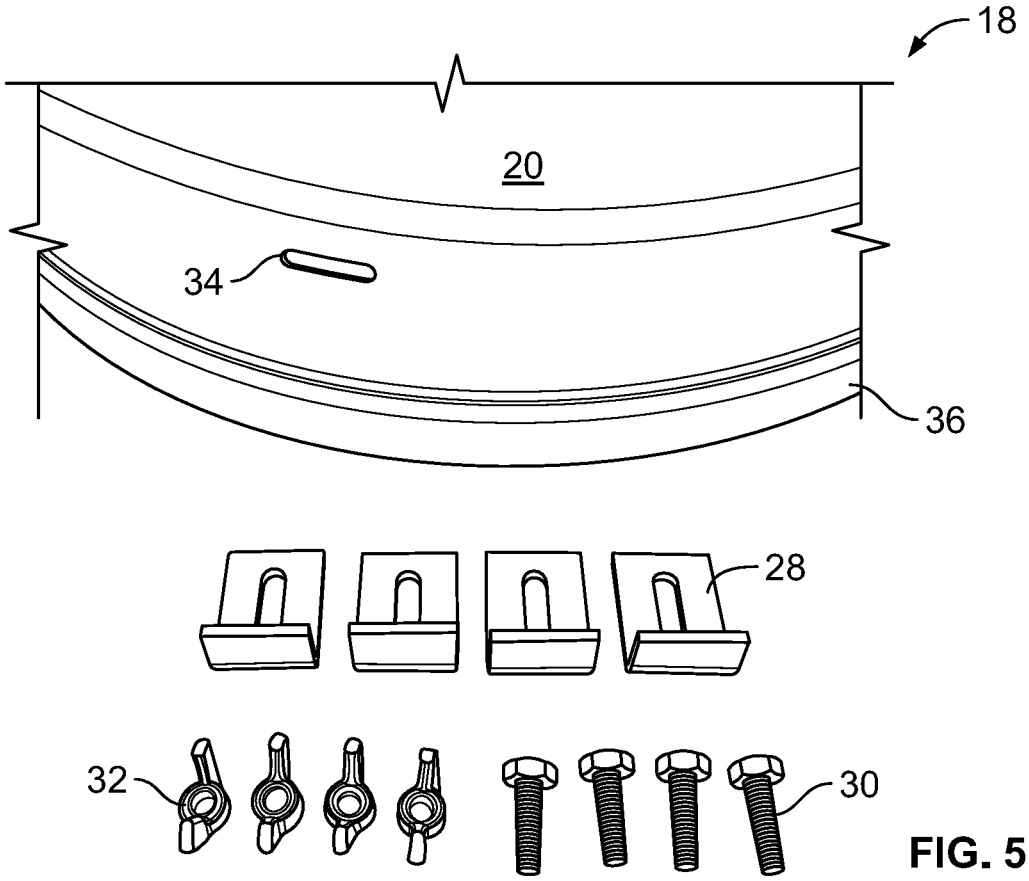
FIG. 5 is an enlarged view of the back of display, including brackets and screws.

Also, shown in FIG. 3 are brackets 28, bolts 30, and wing nuts 32. Shown in greater detail in FIG. 5, the L-shaped brackets fit into slots 34 located along the side of the bowl 18. One such slot 34 is shown in FIG. 5, and can be seen in FIGS. 3 and 1 too. The bolt 28 is placed through the one of four slots 34, located around the perimeter of the bowl 18, from the inside of the bowl 18 so the head of the bolt 34 is inside the bowl 18 and the threaded end of the bolt 34 is outside the bowl 18. The threaded end of the bolt 34 then goes through the open slot in the center of the bracket 28, which is outside the bowl, so that the L-shaped foot of the bracket 28 is closest to the open top of the bowl 18. The brackets 28 can then slide a short distance between the open and closed end of the bowl as needed to attach the display to the tire (the process described in greater detail below). The wing nuts 32 thread onto the threaded end of the bolts 30 to clamp the brackets 28 to the bowl 18. The direction of the bolts 30 can be reversed as well, such that the threaded end is inside the bowl 18, and the head of the bolts 30 outside.

The display attaches to the center opening in the tire 12 by placing the bowl 18 inside the center opening so the closed end of the bowl 20 is inside the tire 12, and the open end of the bowl 18 is at least partially on the outside of the opening in the center of the tire 12. The bowl 18 extends into the tire 12 to the point where the lip 36 on the open end of the bowl meets the outside edge of the opening in the center tire (the bead wall), which acts as a stop preventing the display 10 from moving any further into center of the tire 12.

The bolts 30 can then be inserted through the slots 34 in the bowl 18, and the brackets 28 secured to the side of the bowl 18 as described above. The brackets 28 slide toward the open end of the bowl 18 until they meet the inside of the center of the tire 12 (bead wall) and form a press fitting with the side of the bowl 18. The wing nuts 32 are then secured to the bolts 30 and tightened against the brackets 28, and the display 10 is affixed to the tire 12.

Figure 4:
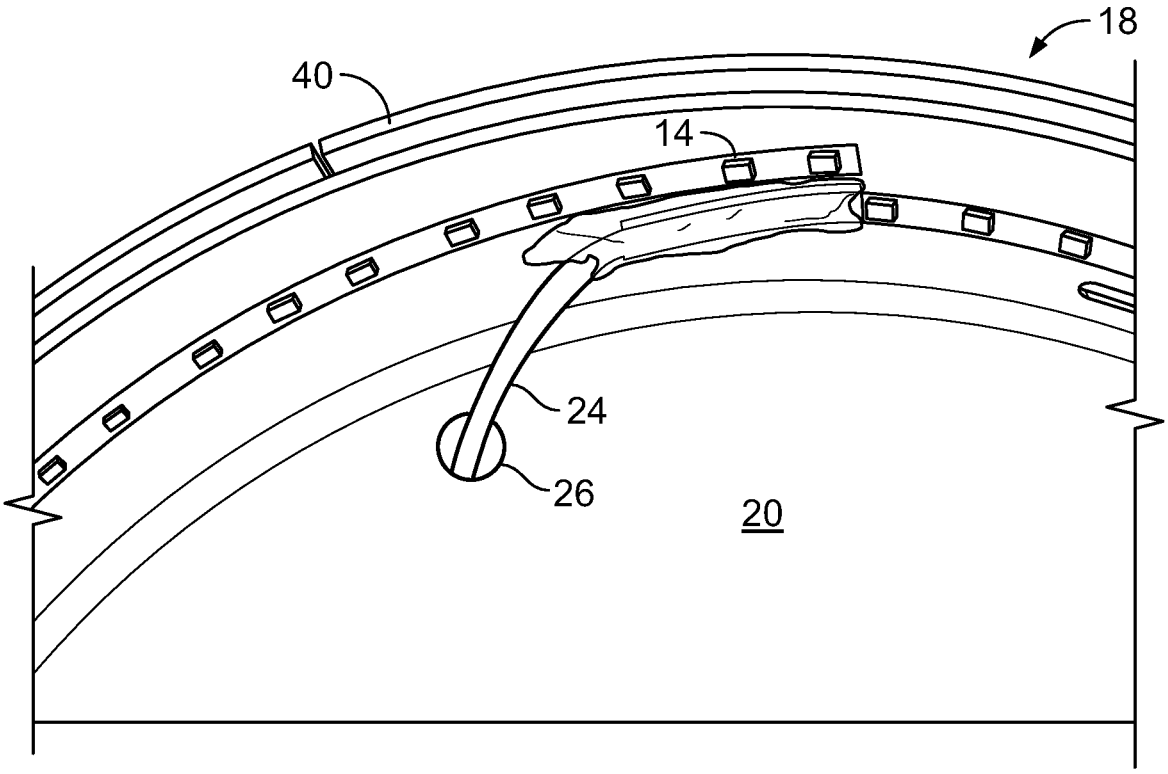
FIG. 4 is an enlarged view of the top portion of the display shown in FIG. 3.
Figure 6:
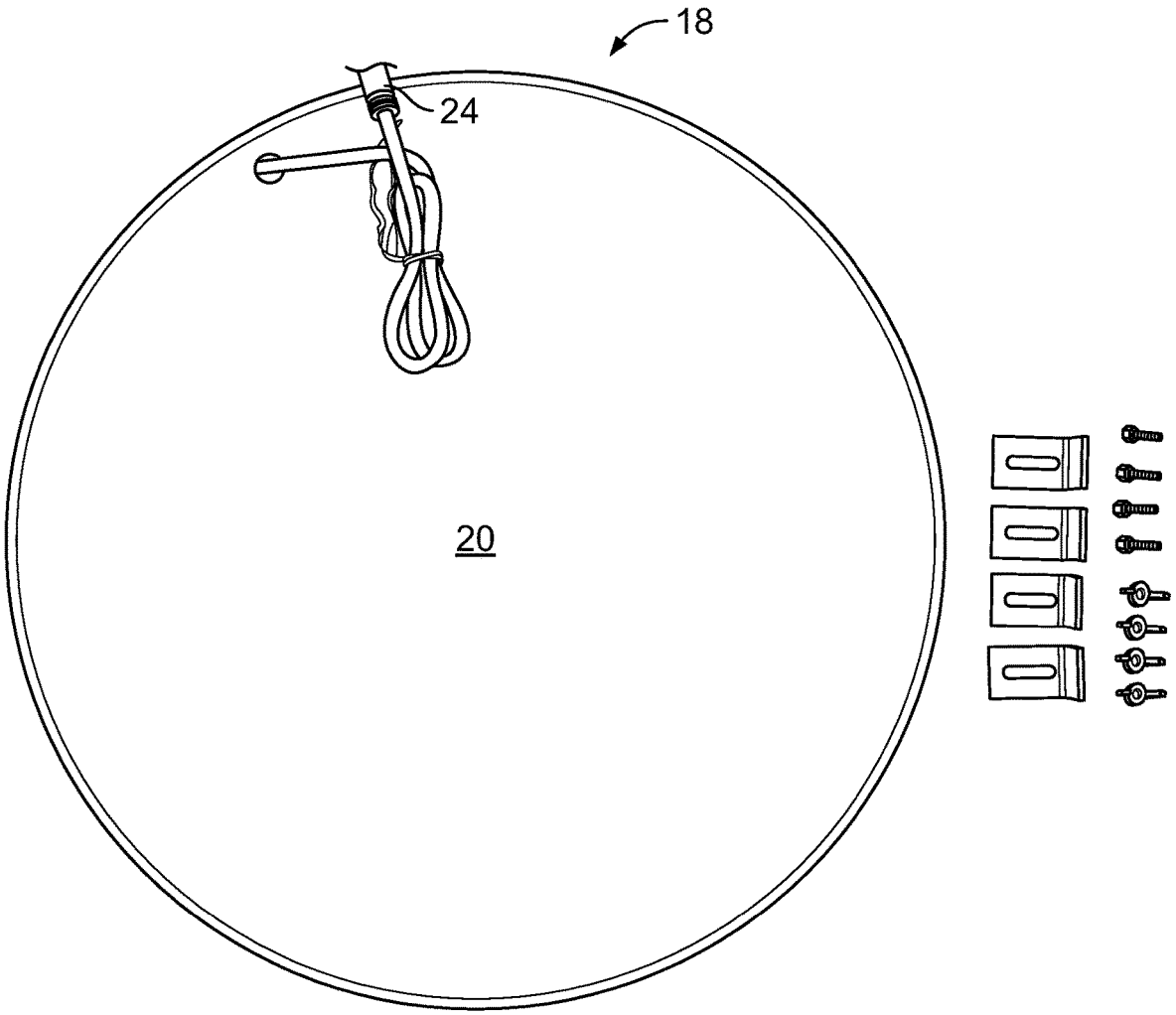
FIG. 6 is a back view of the display, including brackets and screws.

As shown in FIG. 1, an SEG graphic 38 display is fitted over the open end of the display 10, which is positioned in the center of the tire 14. The graphic 38 preferably is a Silicone Edge Graphic (SEG). SEGs are a high-resolution dye-sublimated fabric graphic finished with a thin silicone strip at the edge (or welt/gasket). The silicone strip is sewn directly to the edge of the graphic 38, and the strip is then inserted into a circular channel 40 along the outer circumference of the edge of the open end of the bowl 18. The channel 40 is seen in FIG. 3, and FIG. 4 (close up of a portion of the channel 40). The SEG graphic 38 is pressed into the channel 40. The LED power cord 24 is plugged into a power source and the SEG graphic 38 illuminated by the LED lights 14 on the inside of the bowl 18. FIG. 6 shows the back of the bowl 18 along with the power cord 14.

Figure 7:
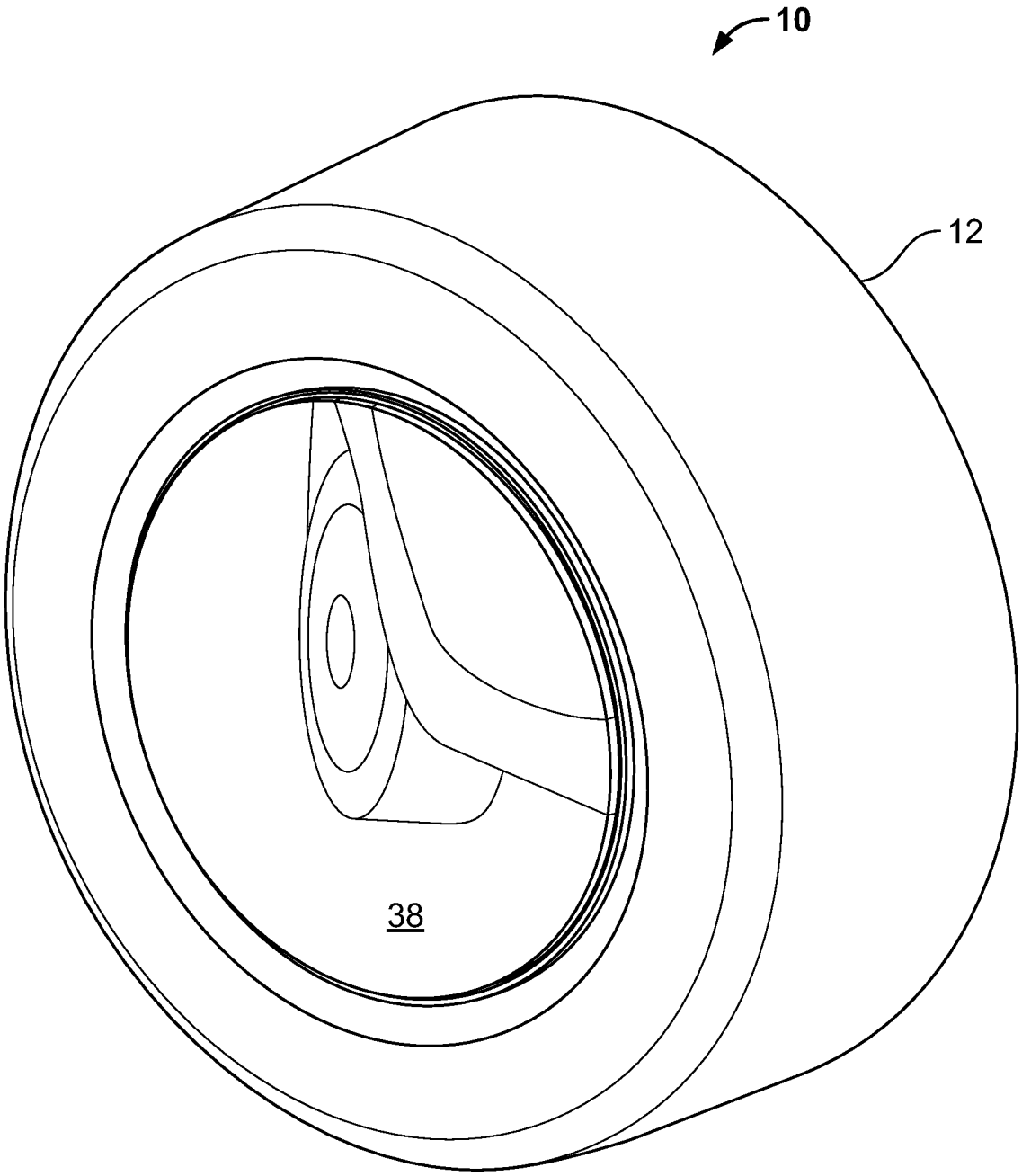
FIG. 7 is a perspective view of the lighted display mounted in the center of a tire.
Figure 8:
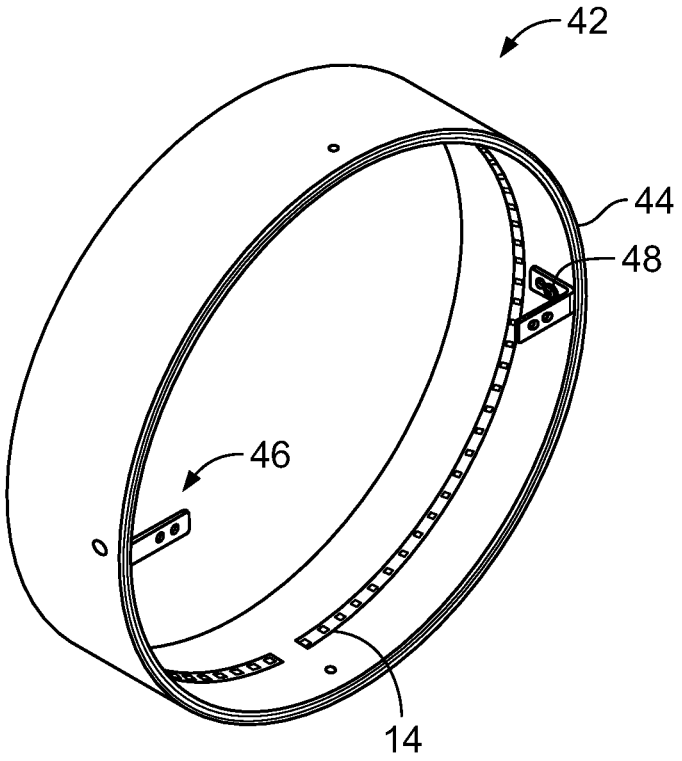
FIG. 8 is a perspective view of a frame.
Figure 9:
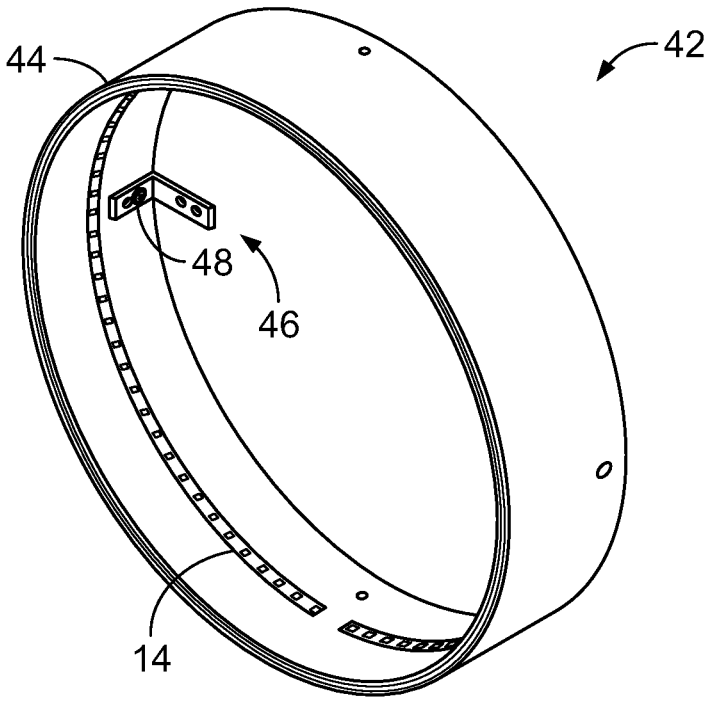
FIG. 9 is a perspective view of the frame from the side opposite from the one shown in FIG. 8.
Figure 10A:
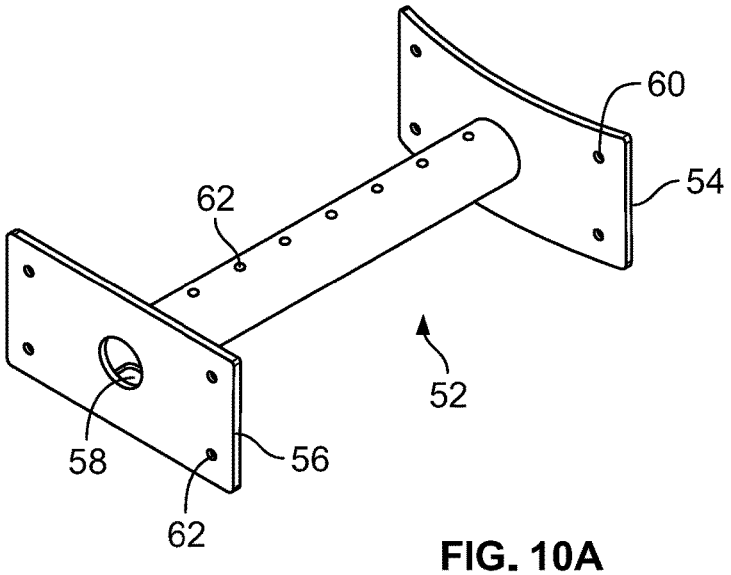
FIG. 10A shows a perspective view of an external bracket.
Figure 10B:
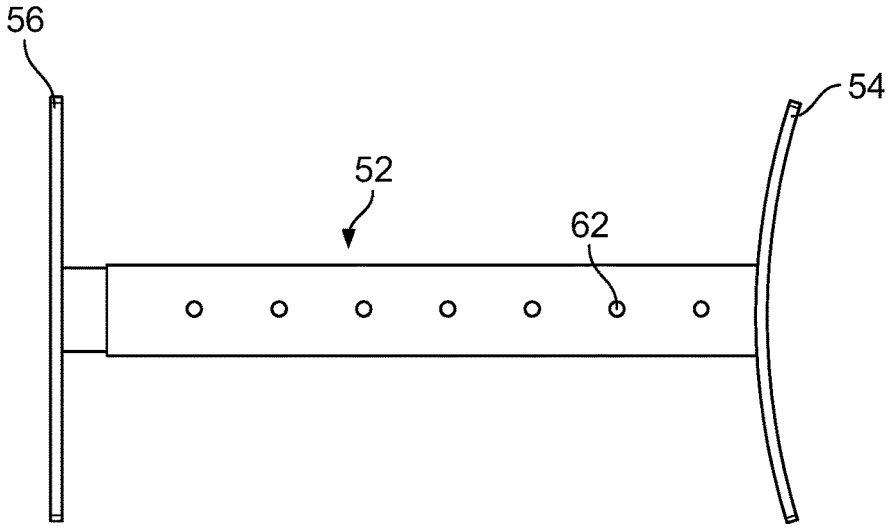
FIG. 10B shows a first side view of the bracket.
Figure 10C:
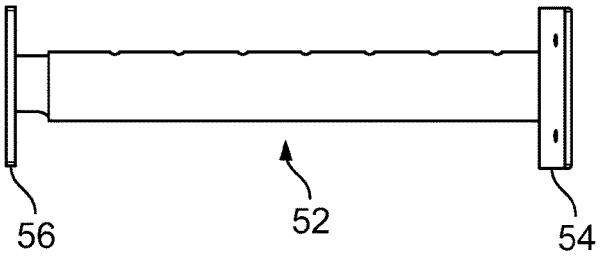
FIG. 10C shows a second side view of the bracket.
Figure 10D:
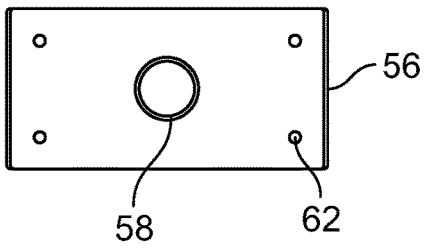
FIG. 10D shows an end view of the bracket.
Figure 11:
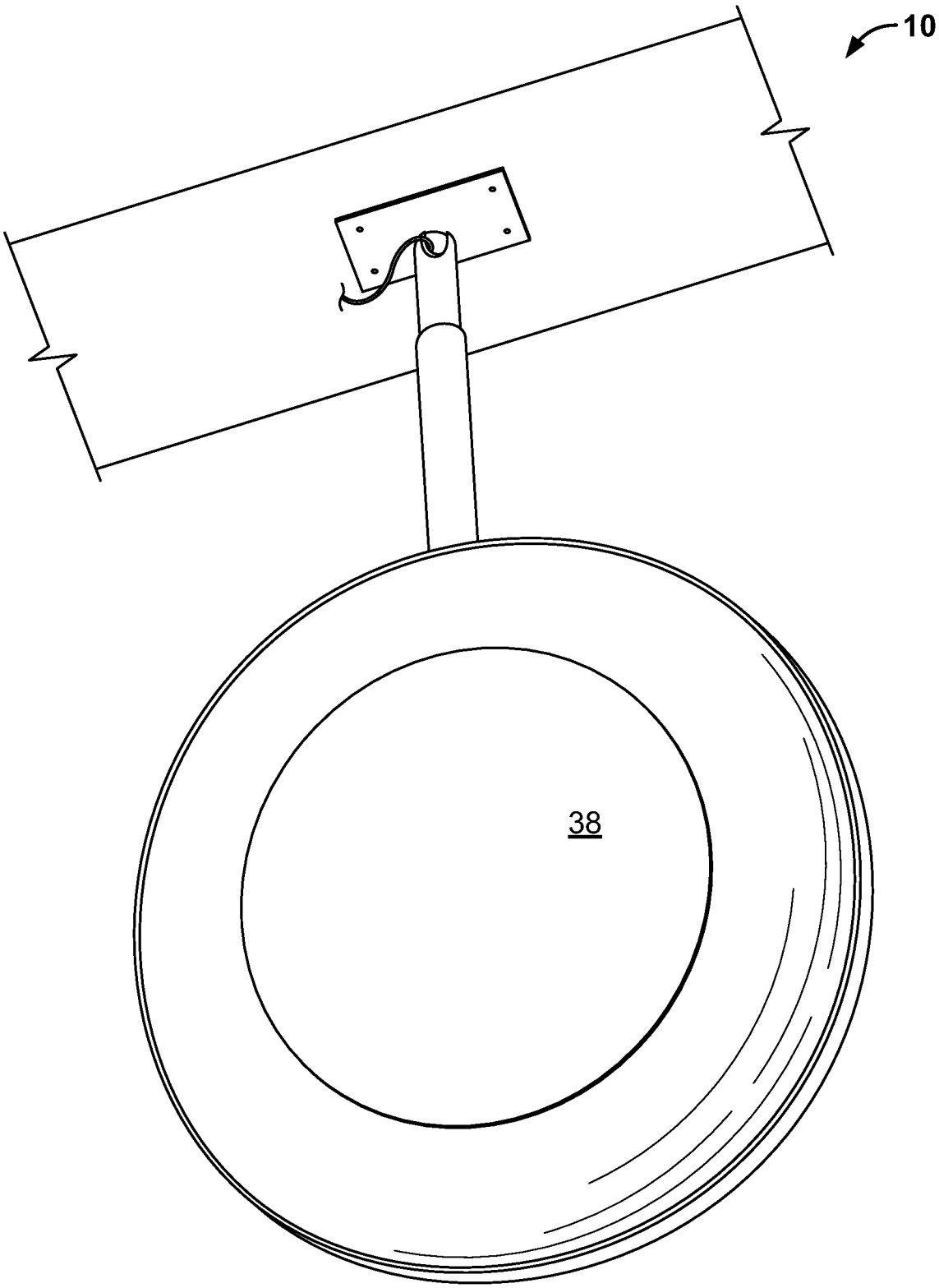
FIG. 11 shows a perspective view of ceiling mounted display.
Figure 12:
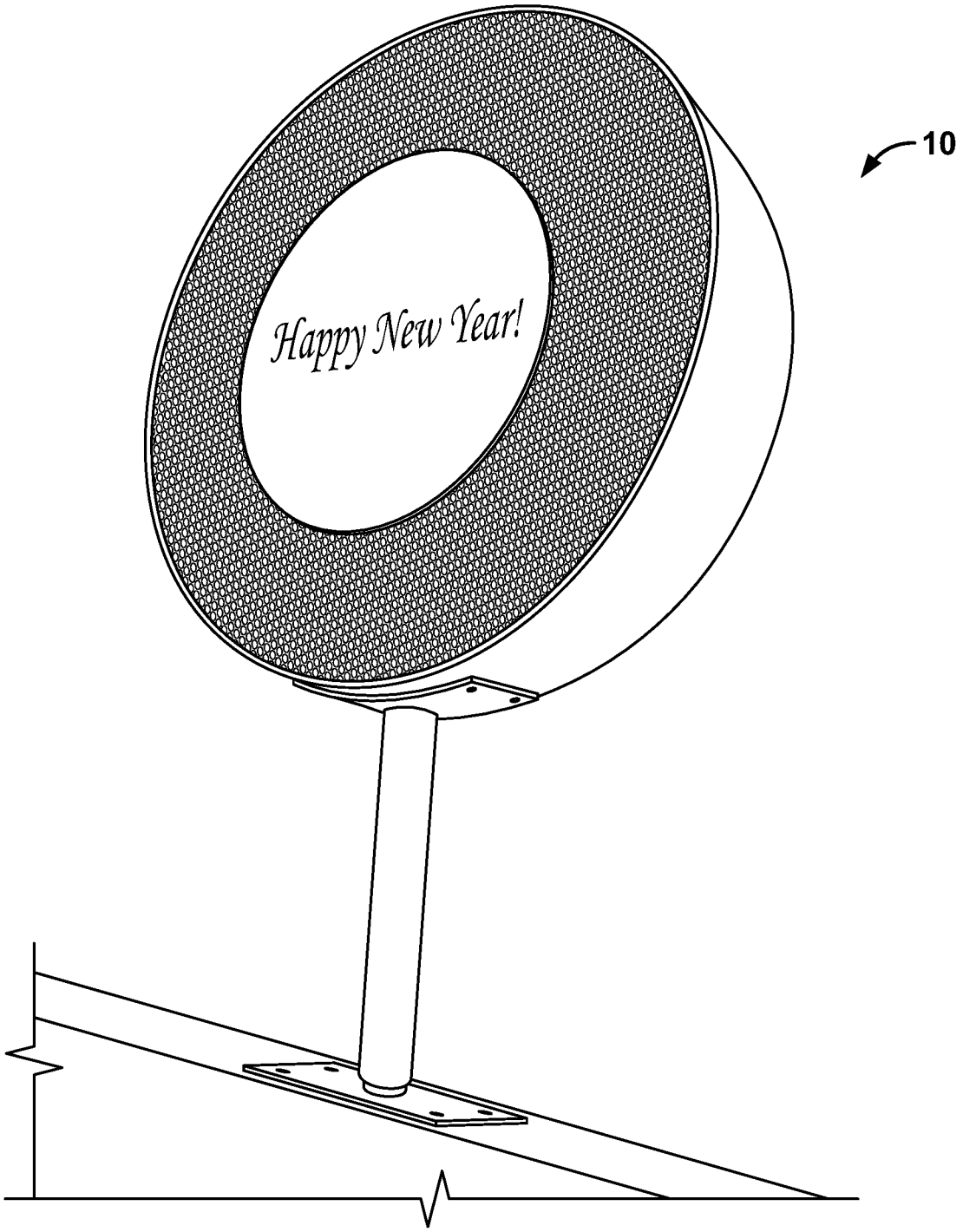
FIG. 12 shows a perspective view of a display mounted from below.

The display can be sized as needed to fit into the opening of any tire 12. The display can be used to display advertising, informational, or promotional material on the SEG 38, especially at places where tires are sold, displayed, serviced, and the like. An example of a lighted graphic display is shown in FIG. 7.

The display can be easily removed or transferred to a different tire simply by loosening and removing the wing nuts 32, bolts 30, and brackets 28 and sliding the display out of the center of the tire 12.

Further, the SEG graphic 38 can be used without the LED lights providing backlighting. The graphic can be a stand along item. In another embodiment of the invention, the graphic is replaced with a video monitor that can be fitted over the open end of the bowl to display video on the monitor. Cables from the monitor would run through the back to a system for delivering video content.

The display 10 can include additional lighting effects such as a strobe light that can produce light flashes to simulate lightening and other light effects, or a speaker to produce audio, or video effects by placing a projector inside the display 10, or replacing the SEG with a thin video monitor.

FIGS. 8-12 show an additional embodiment of the present invention. This embodiment comprises a circular frame 42, with an internal ring of LED lights 14 (see FIGS. 8, 9). The frame 42 includes two SEG channels 44, one on either side of the frame 42. In this manner both the open ends of the frame 42 can be enclosed with a graphic 38, by fitting the edges of the graphic 38 into the channels 42 creating a two sided display 10 (see FIGS. 11, 12).

The frame 42 includes internal brackets 46. The brackets 46 are L-shaped, with one end attached to the frame with a screw 48. The brackets 46 have a slot to allow the bracket to be adjusted as needed. The non-slotted end of the brackets 46 have holes 50 to allow for mounting the display 10 to a suitable surface. In this case, only one SEG 38 maybe used.

An external bracket 52 is shown in FIG. 10. The bracket secures to the outside of the frame 42, where a curved end 54 can be attached to any location on the frame 42 with screws, or with a threaded bolt, that fit through holes 60. The opposite flat end 58 can then be mounted to a wall, or floor or any other surface with screws or threaded bolt, through holes 62. The stem of the bracket 52 is hollow, and a knockout hole 58 extends there-through and through holes in the ends 54, 56 for power cords to pass though such that the display 10 can be powered without any cords showing. With the bracket 52 two graphics 38 can be secured to the channels 44 creating a two sided display 10.

The bracket 52 includes two stem sections that are telescoping to allow for adjusting the length of the bracket 52. Holes 62 in the stem section can be selectively aligned and then fixed in place with bolt and nut connectors.

The above specification and accompanying Figures are for illustrative use only. The scope of the present invention is defined by the following claims. The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A lighted display for use with an ornamental tire, comprising:

a tire having a central opening;

a circular frame mounted into the central opening of the tire, and having an open end and a closed end, and whereby the outside perimeter of the open end has a diameter that exceeds the diameter of the diameter of the central opening of the tire;

an stretchable flexible graphic attached to the open end of the frame by fitting into a channel around the perimeter of the open end of the frame, whereby the graphic covers the open end of the frame;

an array of LED lights disposed around the inside perimeter of the frame to illuminate the display; and a plurality of brackets affixed to the outside of the frame through slots in the outside of the frame, whereby the brackets clamp the frame to the inside of the tire.

2. The display of claim 1 where the frame is open on both ends, and further comprises two channels on each end to receive two graphics.

3. The display of claim 2 further comprising an external mounting bracket.

4. The display of claim 3 where the frame is circular.

5. The display of claim 3 where one end of the bracket is curved to mate with the circular frame and secured thereto.

6. The display of claim 3 where the bracket is hollow and includes a knockout adapted for electrical wires to extend there-through.

7. The display of claim 3 the bracket is telescoping for adjustment of the length.

* * * * *